US005791397A

United States Patent [19]

Suzuoki et al.

[11] Patent Number: 5,791,397

[45] Date of Patent: Aug. 11, 1998

[54] PROCESSES FOR PRODUCING MG-BASED COMPOSITE MATERIALS

[75] Inventors: Masayoshi Suzuoki; Hiromitsu Kaneda; Yoshinobu Sano, all of Hamamatsu; Takao Cho, Nagoya, all of Japan

[73] Assignee: Suzuki Motor Corporation, Hamamatsu, Japan

[21] Appl. No.: 614,157

[22] Filed: Mar. 12, 1996

[30] Foreign Application Priority Data

| | | | |
|---|---|---|---|
| Sep. 22, 1995 | [JP] | Japan | 7-267988 |
| Sep. 22, 1995 | [JP] | Japan | 7-267989 |
| Dec. 28, 1995 | [JP] | Japan | 7-343469 |

[51] Int. Cl.[6] ..... B22D 19/14; B22D 29/00; B05D 7/00

[52] U.S. Cl. ..... 164/97; 164/98; 164/132; 427/217; 427/376.7; 427/383.5

[58] Field of Search ..... 164/97, 98, 132; 427/217, 376.7, 383.5

[56] References Cited

U.S. PATENT DOCUMENTS

| | | | |
|---|---|---|---|
| 4,376,803 | 3/1983 | Katzman | 428/408 |
| 4,889,774 | 12/1989 | Fukizawa et al. | 428/614 |
| 5,013,523 | 5/1991 | Hata et al. | 419/19 |
| 5,228,494 | 7/1993 | Rohatgi | 164/97 |
| 5,626,692 | 5/1997 | Rohatgi et al. | 164/97 |

FOREIGN PATENT DOCUMENTS

| | | | |
|---|---|---|---|
| 0365365 | 4/1990 | European Pat. Off. . | |
| 56-139254 | 10/1981 | Japan | 164/132 |
| 7-310131 | 11/1995 | Japan . | |

OTHER PUBLICATIONS

Patent Abstracts of Japan, vol. 11, No. 150 (C–422), May 15, 1987, & JP 61284541A (Ube Ind Ltd), Dec. 15, 1986.

Patent Abstracts of Japan, vol. 14, No. 47 (CO682), Jan. 29, 1990 & JP 01279719A (Toyota Motor Corp), Nov. 10, 1989.

Database WPI Section Ch, Week 8603, Derwent Publications Ltd., London, & JP 60243245A (Toyoda Automat Loom KK0, Dec. 3, 1985.

Journal of Materials Science 22 (1987), pp. 144–148, "Fibre coatings for the fabrication of graphite–reinforced . . . ".

*Primary Examiner*—Joseph J. Hail, III
*Assistant Examiner*—I.-H. Lin
*Attorney, Agent, or Firm*—Jacobson, Price, Holman & Stern, PLLC

[57] ABSTRACT

The present invention relates to a process for producing a Mg-based composite material by using Mg or a Mg alloy as the matrix and utilizing a spontaneous infiltration phenomenon. This process comprises the step of bringing a powder mixture composed of a reinforcing agent and a infiltration agent into contact with a molten matrix metal comprising Mg or a Mg alloy, so as to cause the molten matrix metal to infiltrate into the powder mixture. The present invention also relates to a process for producing a Mg-based composite material which comprises the steps of forming a preform composed of a reinforcing agent and a infiltration agent and causing a molten matrix metal comprising Mg or a Mg alloy to infiltrate into the preform.

19 Claims, 11 Drawing Sheets x 1000 x 100

PROCESSES FOR PRODUCING MG-BASED COMPOSITE MATERIALS

FIELD OF THE INVENTION AND RELATED ART STATEMENT

This invention relates to processes for producing metal-based composite materials comprising Mg or a Mg alloy as the matrix.

First of all, a first object of the present invention is described below.

Typical methods of making composite materials comprising a metal as the matrix include the melt stirring process, the powder metallurgical process, the squeeze casting process, and the Primex process which is a relatively new method developed by the Lanxide company.

The melt stirring process comprises adding a reinforcing agent to a molten metal while stirring the latter with an stirring blade.

The powder metallurgical process comprises premixing a powdered matrix metal with a powdered reinforcing agent, molding this mixture, and then processing the molded article, as by hot extrusion, to form a composite material.

The squeeze casting process comprises providing a preform made of a reinforcing agent, placing the preform in a mold, and then pouring a molten metal into the mold under pressure so as to cause the molten metal to infiltrate into the preform.

The Primex process comprises, as illustrated in FIG. 19, charging a powder comprising reinforcing particles 99 into a crucible 1 placed in a heating furnace, disposing an ingot (e.g., of an Al—Mg alloy) 97 forming a matrix on top of the powder, heating the crucible 1 in an atmosphere comprising $N_2$ gas or a mixed gas composed of $N_2$ gas and an inert gas to melt the Al—Mg alloy ingot 97, and causing the resulting molten metal to infiltrate into the reinforcing particles 99 without the application of pressure.

However, these processes have the following disadvantages.

The melt stirring process has the disadvantage that the addition of a reinforcing agent and the concomitant mechanical stirring cause the atmosphere gas to be incorporated into the molten metal, resulting in the formation of gas bubbles and a reduction in the mechanical properties of the material. Moreover, when the reinforcing agent has a small particle diameter, it tends to agglomerate. This is problematic because such agglomerations are hard to disintegrate and hinder the particles from being dispersed uniformly.

The powder metallurgical process is suitable for the production of shaped sections, but has the disadvantage that it is difficult to produce members of near net form.

The squeeze casting process has the disadvantage that, since a preform is used, the shape and volume percentage of the reinforcing agent are restricted.

As to the Primex process, the reported applications thereof are limited to the use of a molten metal comprising an Al—Mg alloy. Moreover, the Primex process involves the use of relatively high temperatures and, therefore, is not suitable for use with Mg and Mg alloys which have a high vapor pressure.

Accordingly, the first object of the present invention is to provide a process for producing a metal-based composite material comprising Mg or a Mg alloy as the matrix which process can solve the above-described problems. Next, a second object of the present invention is described below.

As will be described later, the present inventor has developed a process for producing a metal-based composite material comprising Mg or a Mg alloy as the matrix. This process is characterized by using a infiltration agent in the formation of a composite material. The mechanism of the formation of a composite material is such that the reinforcing agent is locally heated to high temperatures as a result of the reaction of the infiltration agent with molten Mg or Mg alloy, and this improves the wettability of the reinforcing agent by molten Mg or Mg alloy and thereby causes the molten metal to infiltrate into the powder of the reinforcing agent, resulting in the formation of a composite material.

On the basis of the above-described mechanism, any substance that reacts exothermically with a molten metal comprising Mg or a Mg alloy can possibly be used as the infiltration agent.

However, the number of infiltration agents actually useful for practical purposes is rather limited because they must meet some requirements. For example, (a) they must produce a sufficient quantity of heat to improve the wettability of the reinforcing agent by the molten metal, and (b) they should preferably have a smaller particle diameter than the reinforcing agent.

Under the present situation, silica ($SiO_2$) is considered to be the most suitable infiltration agent meeting the above-described requirements (a) and (b). However, silica ($SiO_2$) cannot be used as the infiltration agent for Mg alloys containing Zr (zirconium). The reason for this is that the effect of Zr is lost in the presence of Si.

Moreover, it has been shown by experiment that, as can be seen from FIG. 4, the amount of infiltration agent required for the occurrence of infiltration decreases as the particle diameter of the infiltration agent becomes smaller. However, it is difficult to obtain finely powdered silica ($SiO_2$) having a particle diameter of 5 μm or less. Even if such silica can be obtained, it is very expensive.

Accordingly, the second object of the present invention is to provide a process for producing a Mg-based composite material which process is applicable to Mg alloys containing Zr and uses an inexpensive infiltration agent having a small particle diameter.

Next, a third object of the present invention is described below.

Mg alloys have lower hardness than Al alloys. Accordingly, Mg alloys have been unsuitable for use as sliding members because of their poor abrasion resistance. In order to solve this problem, various attempts have been made to reinforce Mg or a Mg alloy by incorporating therein a hard substance such as SiC or $Al_2O_3$. In fact, composite materials having such a hard incorporated therein exhibit excellent abrasion resistance.

Meanwhile, it is well known that materials containing a substance having self-lubricating properties, such as C (graphite) or hBN (hexagonal boron nitride), have excellent characteristics for use as sliding members.

Mg-based composite materials having a hard substance (e.g., SiC) incorporated therein exhibit excellent abrasion resistance. However, they severely attack the opposite material, so that their use as sliding members is restricted. Moreover, they have poor machinability because of the inclusion of a hard substance.

On the other hand, it may readily be presumed that Mg-based composite materials containing a substance having self-lubricating properties, such as C (graphite), will have excellent characteristics for use as sliding members.

However, since C (graphite) and hBN (hexagonal boron nitride) have very poor wettability by a molten metal comprising Mg or a Mg alloy, such composite materials cannot easily be produced even by the squeeze casting process (or melt forging process). Only the powder metallurgical process is considered to permit the formation of a composite material, but this process involves a number of problems such as a high production cost, a great danger from Mg powder, and a restriction on shape.

Accordingly, the third object of the present invention is to provide a process for producing a Mg-based composite material containing a substance having self-lubricating properties which process does not involve the above-described problems.

Next, a fourth object of the present invention is described below.

In order to produce partly reinforced composite materials, it is the most common practice to employ the squeeze casting process. According to this process, a preform for use in a reinforced part is first made. Then, as illustrated in FIG. 20, the preform 105 is charged into a metal mold 101. After a molten metal 103 is poured into the mold 101 from above, pressure is applied by means of a punch 107. Thus, the molten metal 103 is caused to infiltrate into the preform 105, resulting in the formation of a composite material.

Since a ceramic material added as a reinforcing agent has poor wettability by a molten metal, the molten metal does not easily infiltrate into the preform. For this reason, the conventional gravity casting or low-pressure casting process is not suitable for this purpose, and a completely reinforced composite material cannot be produced without the application of pressure. Consequently, when a ceramic material is used as a reinforcing agent, equipment for pressurizing the molten metal is required. This is disadvantageous from the viewpoint of cost.

Accordingly, the fourth object of the present invention is to provide a process for producing a partly reinforced composite material comprising Mg or a Mg alloy as the matrix which process can solve the above-described problems and does not require any pressurizing equipment.

Next, a fifth object of the present invention is described below.

Conventionally, the pressure casting process (or melt forging process) has been mainly employed to produce metal-based composite materials reinforced with whiskers, short fibers or fibers. According to this process, a preform (or fiber aggregate) is made of such a reinforcing agent and then impregnated with a molten metal under pressure.

Alternatively, especially when fibers are used as the reinforcing agent, the hot pressing process has been employed. According to this process, metal plates (or metal foils) and layers of fibers (or textile made of fibers) are superposed alternately and the resulting assembly is hot-pressed.

Although the pressure casting process permits the formation of partly reinforced composite materials, it is difficult to make an entirely reinforced casting according to this process. Moreover, in order to transmit the applied pressure, the sizes of the runner and the gate need to be increased, resulting in a low yield of castings.

On the other hand, the hot pressing process fails to make products having a complicated shape. Moreover, this process requires expensive equipment and complicated process steps, and hence tends to cause an increase in cost.

Accordingly, the fifth object of the present invention is to provide a process for producing a metal-based composite material comprising Mg or a Mg alloy as the matrix which can solve the above-described problems, can produce entirely reinforced castings without the application of pressure, can reduce the equipment and process burdens, can give a good yield, and can be applied to the production of composite material having a complicated shape.

SUMMARY OF THE INVENTION

In order to accomplish the above-described first object, the present invention provides a process for producing a Mg-based composite material which comprises the step of bringing a powder mixture composed of a reinforcing agent and a infiltration agent into contact with a molten matrix metal comprising Mg or a Mg alloy, so as to cause the molten matrix metal to infiltrate into the powder mixture.

In order to accomplish the above-described second object, the present invention provides a process for producing a Mg-based composite material which comprises the step of bringing a powder mixture composed of a reinforcing agent and a infiltration agent into contact with a molten matrix metal comprising Mg or a Mg alloy, so as to cause the molten matrix metal to infiltrate into the powder mixture, the process being further characterized in that titanium oxide is used as the infiltration agent.

In order to accomplish the above-described third object, the present invention provides a process for producing a Mg-based composite material which comprises the step of bringing a powder mixture composed of a reinforcing agent and a infiltration agent into contact with a molten matrix metal comprising Mg or a Mg alloy, so as to cause the molten matrix metal to infiltrate into the powder mixture, the process being further characterized in that a substance having self-lubricating properties is used as the reinforcing agent.

In order to accomplish the above-described fourth object, the present invention provides a process for producing a Mg-based composite material which comprises the steps of making a preform composed of a reinforcing agent comprising a ceramic material which does not react with Mg and a Mg alloy, and a infiltration agent which reacts with molten Mg and Mg alloy with the evolution of heat; and causing a molten matrix metal comprising a material selected from the group consisting of Mg and a Mg alloy to infiltrate into the preform.

In order to accomplish the above-described fifth object, the present invention provides a process for producing a Mg-based composite material which comprises the steps of making a preform composed of a reinforcing agent comprising a ceramic material which does not react with Mg and Mg alloy, and a infiltration agent which reacts with molten Mg and Mg alloy with the evolution of heat; and causing a molten matrix metal comprising a material selected from the group consisting of Mg and a Mg alloy to infiltrate into the preform, the process being further characterized in that the reinforcing agent comprises at least one material selected from the group consisting of whiskers, short fibers and fibers.

According to the process of the present invention which corresponds to the first object thereof, vigorous stirring is not required as contrasted with the melt stirring process, so that it is possible to prevent mechanical properties from being deteriorated as a result of incorporation of the atmosphere gas.

Moreover, $SiO_2$ powder used as the infiltration agent is so cheap that only a slight increase in cost is caused.

Since the process of the present invention utilizes a infiltration phenomenon, a composite material in a good state of dispersion is obtained even when a reinforcing agent having a small particle diameter is used. In addition, fine particles of MgO are formed in the molten metal and function as a reinforcing agent.

According to the process of the present invention which corresponds to the second object thereof, the process for producing a composite material by using a infiltration agent can also be applied to a Mg alloy containing Zr which has the effect of reducing the size of crystal grains.

Moreover, by applying the process of the present invention to a Mg alloy containing Al, there can be obtained a composite material reinforced by MgO and an Al—Ti intermetallic compound finely dispersed in the matrix.

Furthermore, titanium oxide having a particle diameter of 1 μm or less can be obtained at a low price and this small particle diameter serves to reduce its amount added, resulting an economic advantage.

According to the process of the present invention which corresponds to the third object thereof, a composite material can be made from Mg or a Mg alloy and a substance having self-lubricating properties.

Moreover, the Mg-based composite materials made according to this process has the following excellent characteristics: (a) They contain a substance having self-lubricating properties and, therefore, have excellent wear resistance in themselves; (b) they do not attack the opposite member and, therefore, are suitable for use as sliding members; (c) they have very good machinability; (d) they are light in weight; (e) they can be made at low cost and with little danger; and (f) they can be cast and, therefore, have great latitude in shape.

The reason for its light weight is that C (graphite) and hBN (hexagonal boron nitride) have a density of about 2.2 g/cc and are hence lighter in weight than SiC (about 3.2 g/cc).

According to the process of the present invention which corresponds to the fourth object thereof, no pressurizing equipment is used as contrast with the squeeze casting process, so that this process is advantageous from the viewpoint of cost. Consequently, processing equipment which has heretofore been used for purposes of gravity casting or low-pressure casting can be utilized without any modification.

According to the process of the present invention which corresponds to the fifth object thereof, a metal-based composite material can be obtained without the application of pressure, so that the preform does not undergo any deformation. When whiskers or short fibers are used as the reinforcing agent in this process, they are entangled together to facilitate the making of a preform. Moreover, when fibers are used, a preform can readily be made by weaving or filament winding. Accordingly, the reinforcing agent can be handled easily and, moreover, the amount of binder required is minimized. That is, it is easy to enhance the strength of the composite material.

Moreover, this process does not require equipment such as pressurizing apparatus, so that Mg-based composite materials can be made at low cost.

On the other hand, since the molten metal can pass through the preform, a partly composite casting can be made without melt pouring operation, by disposing a mold of a desired shape under the preform. In this case, the composite part may be formed at any desired place such as a central or intermediate region of the casting.

Furthermore, since the preform itself may serve as a mold, this process is also significant in providing a novel shaping technique.

In addition, this process involves little waste of Mg and can hence be expected to achieve a 100% yield.

DETAILED DESCRIPTION OF PREFERRED EMBODIMENTS

The process of the present invention which corresponds to the first object thereof is more specifically described below with reference to the accompanying drawings.

Mg or a Mg alloy is used as the matrix for metal-based composite materials in accordance with the present invention. Actually, one or more ingots of Mg or a Mg alloy are used in the practice of the present invention.

As the reinforcing agent, there is used a material selected from ceramics such as SiC, $Al_2O_3$, TiC, $9Al_2O_3.2B_2O_3$, $K_2O.6TiO_2$, $Si_3N_4$, AlN and $B_4C$, and other commonly used particulate materials which do not react with Mg. This reinforcing agent should have a particle diameter of 0.1 to 100 μm. If the particle diameter is greater than 100 μm, the resulting composite material will show a reduction in strength, and if it is less than 0.1 μm, the molten composite material will have too high viscosity for practical purposes.

In addition, a infiltration agent is also used. This infiltration agent is mixed with particles of the aforesaid reinforcing agent. Examples of the infiltration agent include $SiO_2$ powder and ZnO powder. That is, this infiltration agent comprises a substance which, upon contact with molten Mg, reacts with it with the evolution of heat.

The amount of infiltration agent added to the reinforcing agent should be in the range of 1 to 99% by volume based on the total volume of the powder mixture composed of the reinforcing agent and the infiltration agent. If the amount of infiltration agent added is less than 1%, no infiltration into the reinforcing agent will occur. If it is greater than 99%, the concentration of the infiltration agent (e.g., Si) will become excessively high even when the volume percentage of the reinforcing agent in the composite material is very low. This will cause a marked rise in the melting point of the alloy and detract from the utility of the Mg-based composite material.

Figure 1:
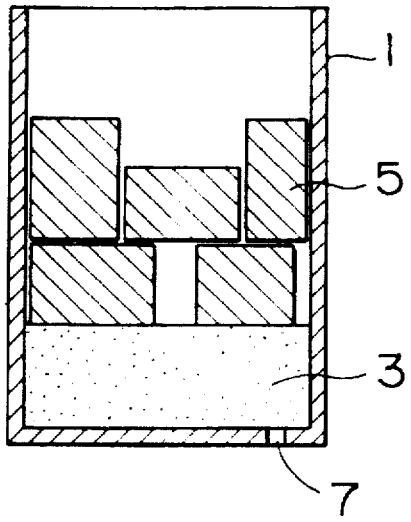
FIG. 1 is a schematic view for explaining some steps in an example of one process in accordance with the present invention which corresponds to the first object.

Referring to FIG. 1, a powder mixture 3 composed of a reinforcing agent and a infiltration agent in a predetermined proportion is first charged into the bottom of a crucible 1 (made of steel) used for melting by the application of heat.

Then, ingots 5 of Mg or a Mg alloy used as the matrix are placed on the powder mixture 3. The bottom wall of the crucible 1 is provided with a vent hole 7.

Figure 2:
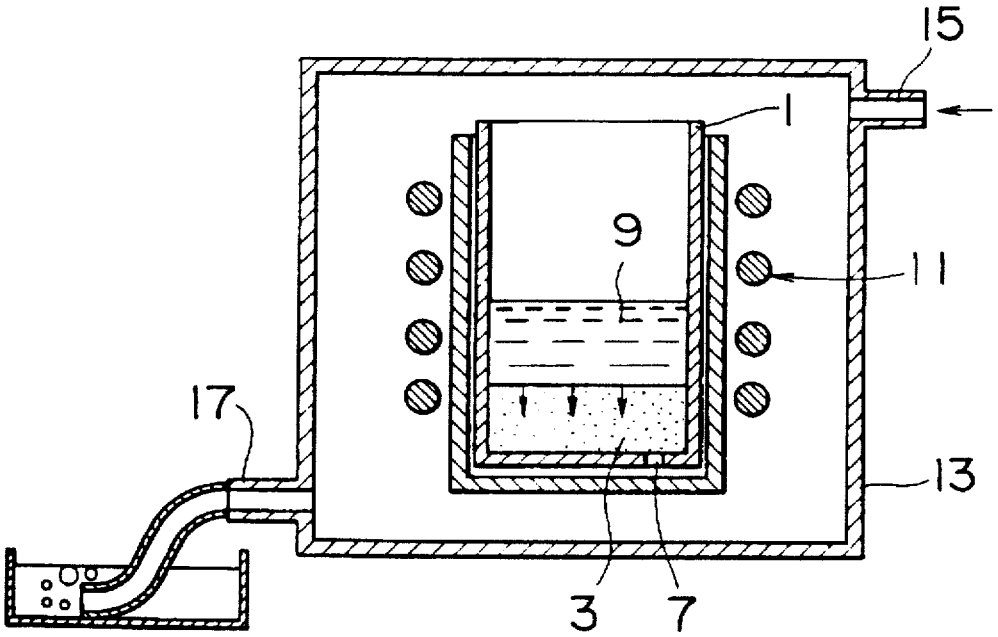
FIG. 2 is a schematic view for explaining the example of the one process in accordance with the present invention which corresponds to the first object.

FIG. 2 illustrates an arrangement suitable for making a Mg-based composite material by using this crucible 1. The aforesaid crucible 1 is placed in a high-frequency induction furnace 11. The high-frequency induction furnace 11 is enclosed in a controlled-atmosphere chamber 13, and this chamber 13 is provided with an inlet 15 for introducing an atmosphere gas into the chamber 13 and an outlet 17 for discharging the displaced atmosphere to the outside.

As the atmosphere gas, there may be used any of various gases commonly used as the atmosphere for melting Mg by the application of heat, such as Ar gas and a mixed gas composed of $CO_2$ and $SF_6$.

The Mg ingots 5 are heated (to about 700° C.) in the aforesaid atmosphere for a predetermined period of time to form molten Mg 9.

This molten Mg 9 infiltrates into the underlying powder mixture 3, during which time the infiltration agent reacts with the molten Mg with the evolution of heat to form magnesium oxide. During infiltration, the gas present in the powder mixture 3 is discharged through the hole 7. Upon completion of the infiltration, the crucible 1 is cooled to obtain a Mg-based composite material having reinforcing particles dispersed therein.

Where it is desired to disperse the reinforcing particles (of SiC or the like) uniformly in the matrix, this may be accomplished by stirring the resulting composite material in such a gentle manner as not to incorporate gas bubbles thereinto, after completion of the infiltration.

EXAMPLE 1

A powder mixture was prepared by intimately mixing 15g of SiC particles having an average particle diameter of 3 μm with 10% by volume of $SiO_2$ particles. Then, as illustrated in FIG. 1, this powder mixture was charged into a crucible made of steel, and about 70g of pure Mg ingots were placed thereon. Thereafter, as illustrated in FIG. 2, the crucible was heated to 700° C. in a high-frequency induction furnace and held at that temperature for 20minutes. The atmosphere comprised argon and its pressure was 1atmosphere.

After cooling, the resulting material was removed and observed under a microscope. This revealed that there was obtained a perfect composite material having a structure substantially free of defects.

Comparative Example 1

For purposes of comparison, the procedure of Example 1 was repeated except that no $SiO_2$ particles were mixed with SiC particles. As contrasted with Example 1, no infiltration into the powder layer of SiC particles occurred.

Next, the process of the present invention which corresponds to the second object thereof is more specifically described below.

Mg alloys for practical use can be divided into two broad categories. One of them comprises Mg—Al alloys (e.g., AZ91, AM60and AS41according to ASTM standards) and the other comprises Mg—Zr (zirconium) alloys (e.g., ZK61, ZE41, QE22and WE54according to ASTM standards).

In the case of Mg—Zr alloys, Zr (zirconium) crystallizes in the molten metal and provides crystal nuclei. This makes crystal grains finer and thereby improves mechanical properties. Accordingly, elements combining with Zr to form a compound, such as Cu, Al and Si, cannot be added to Mg—Zr alloys. The reason for this is that, when existing in the form of a compound, Zr loses its effect.

Under these circumstances, the present inventor has found that titanium oxide is effective as a new infiltration agent. Titanium oxide also undergoes a thermit reaction with Mg and thereby evolves heat. However, the resulting products are MgO and Ti. Ti does not combine with Zr and, therefore, does not detract from the effect of Zr. Moreover, when a Mg—Al alloy is used as the matrix, Ti reacts with Al present in the molten metal to form Ti—Al intermetallic compounds (e.g., $Ti_3Al$, TiAl and $TiAl_3$). These intermetallic compounds contribute to the strengthening of the Mg-based composite material.

Among several types of titanium oxide, $TiO_2$ (anatase type and rutile type) is being widely used as a white pigment. Moreover, since the most prevalent type of $TiO_2$ has a submicron particle diameter (i.e., a particle diameter of less than 1 μm), finely divided $TiO_2$ can be obtained at a low price.

Typical examples of the powdered reinforcing agent used in this process include SiC, C (carbon) and TiAl (titanium aluminide). The powdered reinforcing agent should have a particle diameter of about 0.1to 100 μm. If the particle diameter is less than 0.1 μm, the viscosity of the molten metal will be too high for practical purposes, and if it is greater than 100 μm, the resulting Mg-based composite material will show a reduction in strength.

In the powder mixture composed of the powdered reinforcing agent and titanium oxide, the titanium oxide is present in an amount of 1 to 90% by volume. If the amount of the titanium oxide is greater than 90% by volume, the infiltration rate will be reduced, and if it is less than 1% by volume, no infiltration will occur.

Useful Mg alloys include AZ91, ZK61, QE22 and the like.

EXAMPLE 2

SiC particles (having a particle diameter of 8 μm) used as the reinforcing agent were intimately mixed with 10% by volume of anatase-type $TiO_2$ (having a particle diameter of 0.4 μm) used as the infiltration agent. As the matrix metal, there was used AZ91alloy (i.e., a Mg-9% Al-1% Zn alloy). When this AZ91 alloy was melted at 630° C. by using a layout illustrated in FIG. 3, the molten metal infiltrated into the powder of the reinforcing agent.

Figure 3:
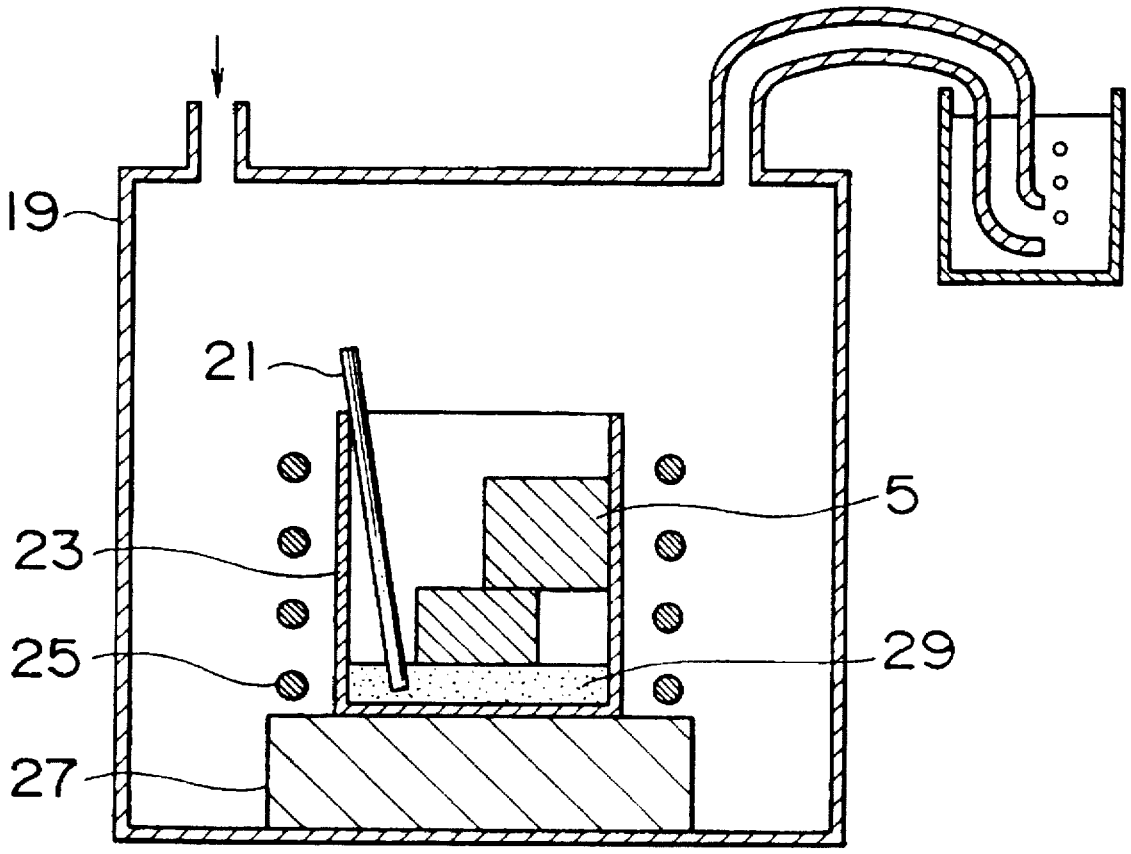
FIG. 3 is a schematic view showing an outline of an apparatus for making a Mg-based composite material by infiltration.
Figure 4:
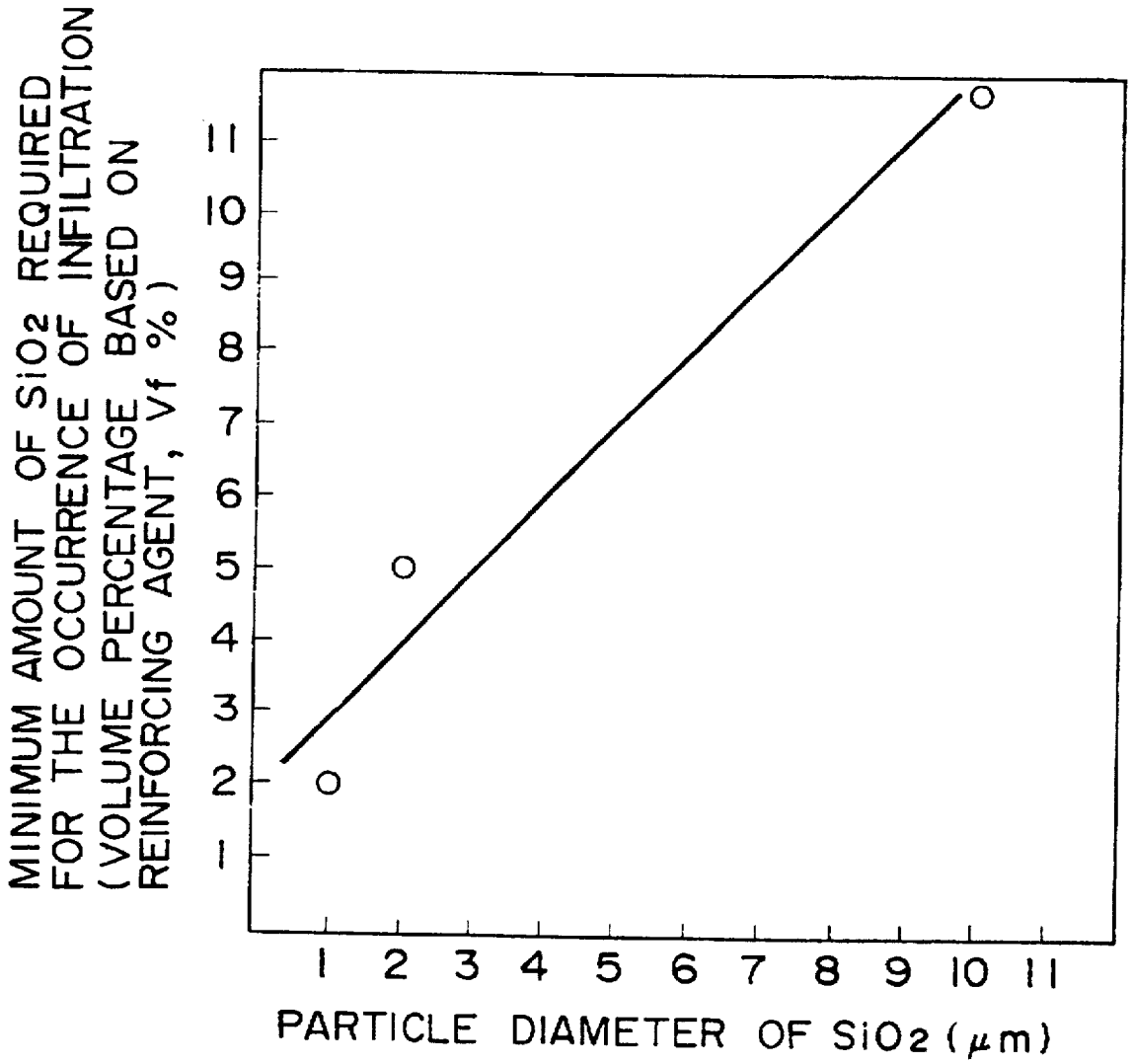
FIG. 4 is a graph showing the relationship between the particle diameter of $SiO_2$ used as the infiltration agent and the amount of $SiO_2$ required for the occurrence of infiltration, when SiC particles (having a particle diameter of 8 μm) are used as the reinforcing agent in accordance with the present invention which corresponds to the second object.
Figure 5:
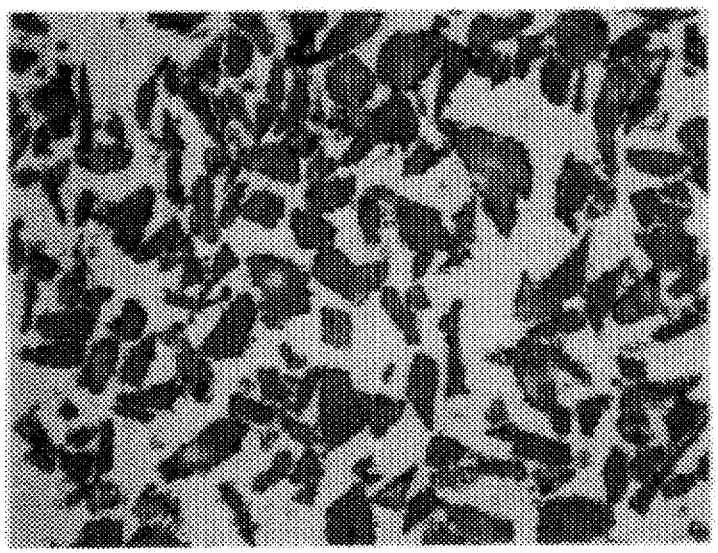
FIG. 5 is a photomicrograph of a Mg-based composite material made by using AZ91 as the matrix, SiC particles having a particle diameter of 8 μm as the reinforcing agent, and anatase-type $TiO_2$ having a particle diameter of 0.4 μm as the infiltration agent.

Referring to FIG. 3, a chamber 19 filled with Ar gas includes a melting crucible 23 placed on a crucible stand 27. The melting crucible 23 is charged with ingots 5 of Mg or a Mg alloy and a powder mixture 29 composed of a reinforcing agent and titanium oxide, and a venting pipe 21 is inserted into the powder mixture 29. When the ingots 5 of Mg or a Mg alloy are heated by an induction coil 25, the resulting molten metal infiltrates into the powder mixture 29. A photomicrograph (1000× magnification) of a microstructure (etched with 1% nitric acid) of the composite material so made is shown in FIG. 5. The gray regions represent SiC particles and the white regions represent the matrix (i.e., AZ91 alloy). In this structure, fine particles comprising MgO and Ti—Al intermetallic compounds are dispersed in the matrix represented by the white regions.

EXAMPLE 3

SiC particles (having a particle diameter of 13 μm) used as the reinforcing agent were intimately mixed with 5% by volume of rutile-type $TiO_2$ (having a particle diameter of 0.4 μm). As the matrix metal, there was used ZK61 alloy (i.e., a Mg-6% Zn-1% Zr alloy). When this ZK61 alloy was melted at 670 ° C. by using a layout illustrated in FIG. 3, the molten metal infiltrated into the powder of the reinforcing agent.

Thereafter, the resulting composite material was mechanically stirred with an stirring blade to disperse the reinforcing agent uniformly into the molten metal comprising ZK61 alloy. After the temperature of the molten metal was raised to 730° C., the molten metal was poured into a mold. When the metallographic structure of the casting was examined, it was confirmed that the grain size was of the order of 30 μm and, therefore, the effect of Zr was not detracted from.

Next, the process of the present invention which corresponds to the third object thereof is more specifically described below.

As described above, the present inventor has developed a process for producing a Mg-based composite material (i.e., a spontaneous infiltration process) in which a infiltration phenomenon is induced by bringing a powder mixture composed of a reinforcing agent and a infiltration agent into contact with a molten matrix metal comprising Mg or a Mg alloy. The mechanism of the formation of a composite material is such that the reinforcing agent is locally heated to high temperatures as a result of the reaction of the infiltration agent with the molten metal comprising Mg or a Mg alloy with the evolution of heat, and this improves the wettability of the reinforcing agent by the molten metal. Consequently, the molten metal infiltrates into the powder of the reinforcing agent to form a composite material.

According to the present invention, it has been found that, when a substance having self-lubricating properties is used as the reinforcing agent in this spontaneous infiltration process, a composite material composed of Mg or a Mg alloy and the substance having self-lubricating properties can be made.

As the reinforcing agent, there is used a substance having self-lubricating properties, such as C (graphite), hBN (hexagonal boron nitride), or $MOS_2$ (molybdenum disulfide).

The reinforcing agent should have a particle diameter of about 0.1to 500 μm. If the particle diameter is less than 0.1 μm, the viscosity of the molten metal will be too high for practical purposes, and if it is greater than 500 μm, the resulting Mg-based composite material will show a reduction in strength.

The spontaneous infiltration process using a infiltration agent makes it possible to make a composite material from a molten metal comprising Mg or a Mg alloy and a substance having very poor wettability thereby, such as C (graphite) or hBN (hexagonal boron nitride).

Typical examples of the infiltration agent include silica and titanium oxide. They undergo a thermit reaction with a molten metal comprising Mg or a Mg alloy and thereby evolve a large quantity of heat, so that the wettability of the reinforcing agent by the molten metal comprising Mg or a Mg alloy can be improved significantly.

In the powder mixture composed of the powdered reinforcing agent and the infiltration agent, the infiltration agent is present in an amount of 1to 90% by volume. If the amount of the infiltration agent is greater than 90% by volume, the viscosity of the molten metal will be too high for practical purposes, and if it is less than 1% by volume, a spontaneous infiltration phenomenon will fail to occur.

Useful Mg alloys include AZ91, ZK61, QE22 and the like.

In the composite material composed of the powdered reinforcing agent and Mg or a Mg metal, the powdered reinforcing agent is present in an amount of 0.1 to 50% by volume. If the amount of the powdered reinforcing agent is greater than 50% by volume, the viscosity of the molten metal will be too high for practical purposes, and if it is less than 0.1% by volume, the composite material will fail to show an improvement in sliding properties.

EXAMPLE 4

C (graphite) particles (having a particle diameter of 70–150 μm) used as the reinforcing agent were intimately mixed with 30% by volume of a-silica (having a particle diameter of 1 μm). As the matrix, there was used AZ91 alloy (i.e., a Mg-9% Al-1% Zn alloy). When this AZ91alloy was melted at 630° C. by using a layout illustrated in FIG. 6, the molten metal infiltrated into the C (graphite) powder.

Figure 6:
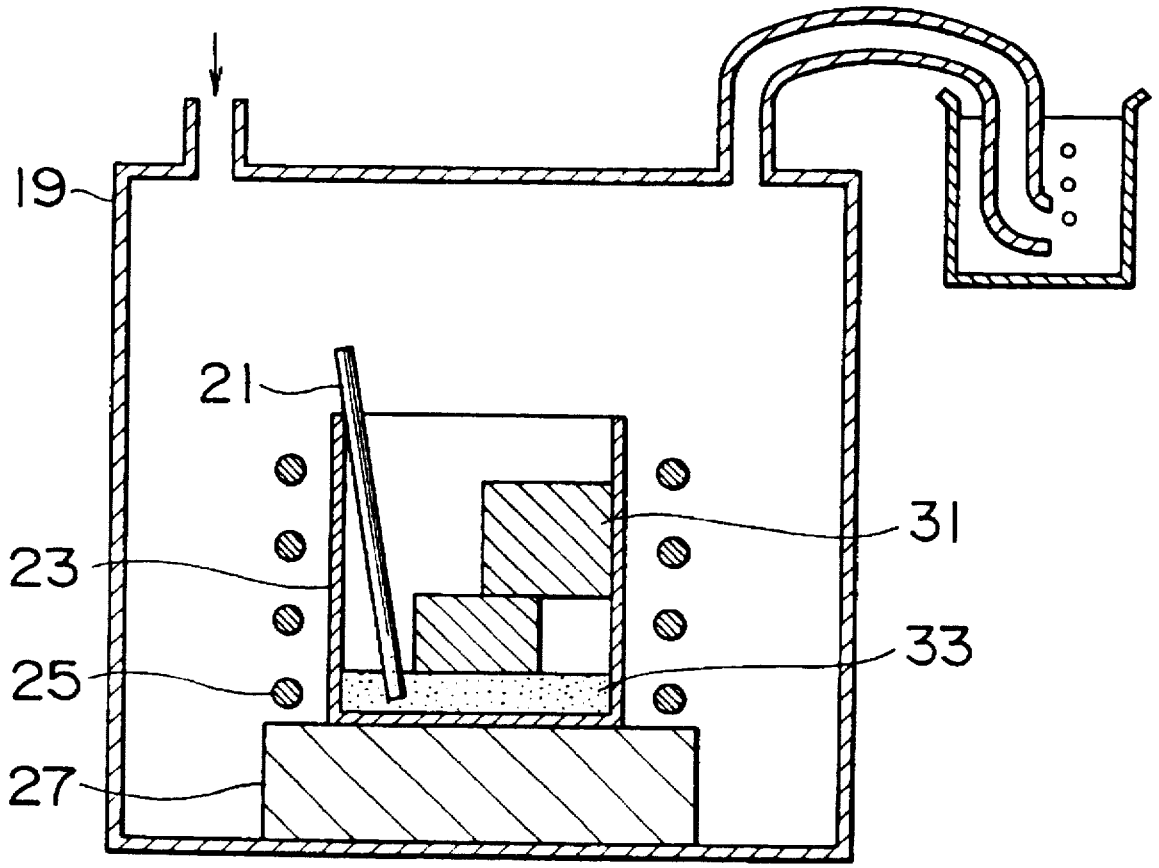
FIG. 6 is a schematic view illustrating an example of another process for producing a Mg-based composite material in accordance with the present invention which corresponds to the third object.

Referring to FIG. 6, a chamber 19 filled with Ar gas includes a melting crucible 23 placed on a crucible stand 27.

The melting crucible 23 is charged with AZ91 alloy ingots 31 and a powder mixture 33 composed of graphite and a-silica, and a venting pipe 21 is inserted into the powder mixture 33. When the AZ91 alloy ingots 31 are heated by an induction coil 25, the resulting molten metal infiltrates into the powder mixture 33.

Figure 7:
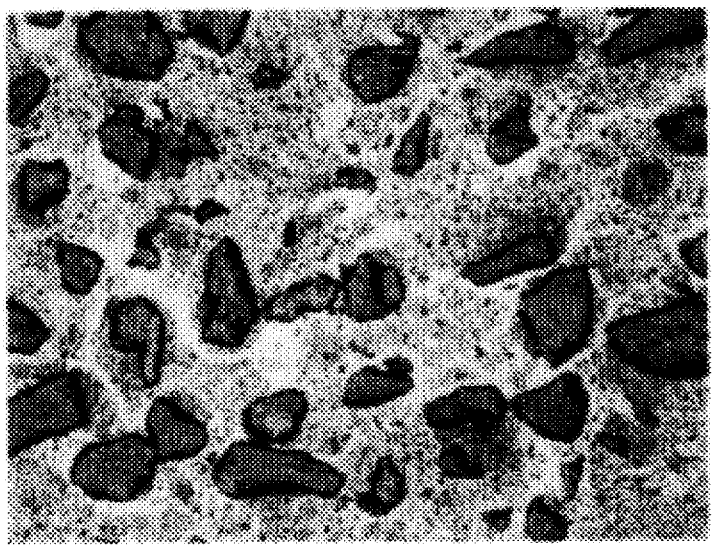
FIG. 7 is a photomicrograph showing the microstructure of a Mg-based composite material made in accordance with the present invention which corresponds to the third object.

FIG. 7 is a photomicrograph (100× magnification) of an unetched microstructure of the Mg-based composite material made by using graphite particles (having a particle diameter of 70–150 μm) as the reinforcing agent and a-silica ($SiO_2$) (having a particle diameter of 1 μm) as the infiltration agent. In this photomicrograph, the black regions represent graphite particles and the white regions surrounding them represent the matrix comprising AZ91alloy. The fine particles observed in the matrix comprise MgO and $Mg_2Si$ which were formed by the reaction of the infiltration agent (i.e., a-silica) with Mg.

Application Example 1

A composite material was made in the same manner as in Example 4, and mechanically stirred with an stirring blade to disperse the graphite particles into the molten matrix metal. After the temperature of the molten metal was raised to 690° C., the molten metal was poured into a mold. Thus, a Mg-based composite material member having excellent sliding properties could be produced easily.

Abrasion Resistance Tests

The specific abrasion wear of a Mg-based composite material made in accordance with the present invention was measured in the following manner: Using an Ogoshi abrasion tester, tests were carried out at a sliding velocity of 1.98m/s and a sliding distance of 600 m. In these tests, a chilled FC250material was used as the opposite material and 10W-40engine oil was used as the lubricant. The load was constant and set at 24.5N or 49N. The results thus obtained are shown in Table 1. It can be seen from these results that the incorporation of graphite particles reduces the specific abrasion wear to ⅓ or below.

TABLE 1

| | Specific abrasion wear (unit: $mm^2/N$) | |
|---|---|---|
| | 24.5 N | 49 N |
| Composite material[1)] | $3.8 \times 10^{-9}$ | $5.5 \times 10^{-9}$ |
| Mg alloy[2)] | $13 \times 10^{-9}$ | $18 \times 10^{-9}$ |

[1)]A Mg-based composite material made by using AZ91 alloy as the matrix, graphite particles (70–150 μm) as the reinforcing agent in an amount of 5% by volume based on AZ91, and titanium oxide (anatase type; 0.4 μm) as the infiltration agent in an amount of 30% by volume based on graphite particles.
[2)]AZ91 alloy used for purposes of comparison.

1) A Mg-based composite material made by using AZ91 alloy as the matrix, graphite particles (70–150 μm as the reinforcing agent in an amount of 5% by volume based on AZ91, and titanium oxide (anatase type; 0.4 μm) as the infiltration agent in an amount of 30% by volume based on graphite particles.

2) AZ91 alloy used for purposes of comparison.

Next, the process of the present invention which corresponds to the fourth object thereof is more specifically described below.

As the reinforcing agent, there is used a ceramic material which does not react with Mg, such as SiC, $Al_2O_3$ or TiC. This reinforcing agent may be in the form of particles, whiskers or fibers, and should have a particle size of 0.1 to 100 μm. As the infiltration agent, there is used $SiO_2$ powder or ZnO powder. This infiltration agent comprises an oxide which, upon contact with molten Mg, reacts with it with the evolution of heat.

Prior to making a preform of the reinforcing agent, the aforesaid infiltration agent is mixed with the reinforcing agent. When $SiO_2$ is used as the infiltration agent, this $SiO_2$ should be present in an amount of 1 to 50% by volume based on the reinforcing agent. If the amount of $SiO_2$ is less than 1% by volume, no beneficial effect will be produced, and if it is greater than 50%, the molten metal will have poor fluidity and fail to infiltrate.

Using the mixture of the reinforcing agent and the infiltration agent, a preform having a predetermined shape is made according to any conventional technique. For example, there may be employed a wet process in which the mixture, together with a binder, is dispersed in a solvent and the resulting slurry is filtered, dried and fired to make a preform.

This preform is preheated to a temperature of 600° to 900° C. and placed in a mold which has been preheated to a temperature of 200° to 500° C.

Then, a molten metal prepared by melting Mg or a Mg alloy separately is poured directly into the mold. That is, casting may be carried out according to the conventional gravity casting or low-pressure casting process. The poured molten metal comes into contact with the preform and reacts with the infiltration agent with the evolution of heat. Thus, the molten metal spontaneously infiltrates into the preform, so that a composite material composed of the molten metal and the preform can be made without requiring the application of pressure. The infiltration agent reacts with the molten metal with the evolution of heat, resulting in the formation of magnesium oxide.

EXAMPLE 5

Figure 8:
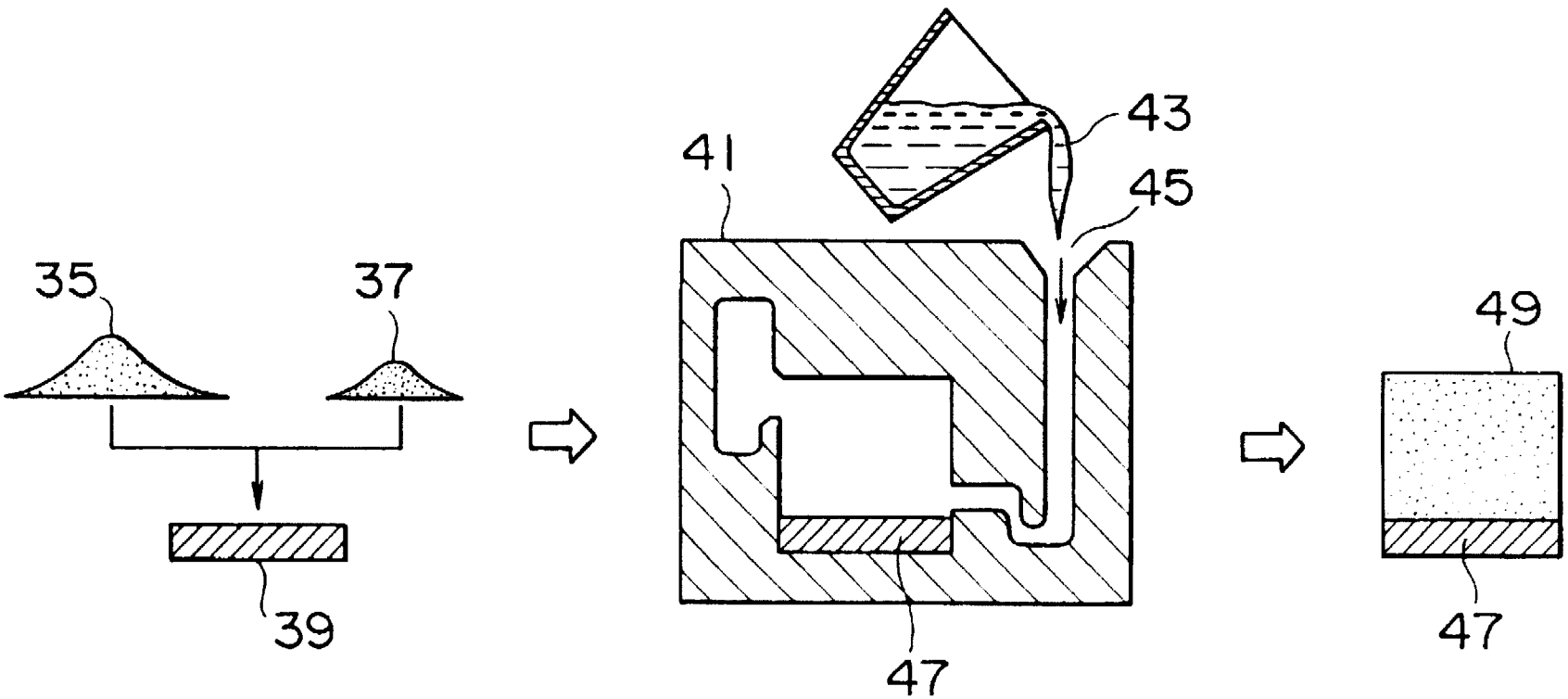
FIG. 8 is a schematic view for explaining some steps in an example of still another process in accordance with the present invention which corresponds to the fourth object.

As shown in FIG. 8, a reinforcing agent 35 comprising SiC (having a particle diameter of 10 μm) was mixed with 20% by volume of a infiltration agent 37 comprising $SiO_2$ to make a preform 39 for use in partial reinforcement.

This preform 39 was preheated to 750° C. and placed in a mold 41 which had been preheated to 300° C.

A molten metal 43 comprising pure Mg was poured into the mold 41 through its sprue 45. After the molten metal was solidified, the resulting product 49 was removed.

Examination of the product 49 revealed that the matrix comprising Mg had fully infiltrated into the preform 47 and the reinforced part was uniform in quality.

Next, the process of the present invention which corresponds to the fifth object thereof is more specifically described below.

In this process, the reinforcing agent comprises a material selected from whiskers, short fibers and fibers, or a mixture of such materials. This reinforcing agent is mixed with a infiltration agent to make a preform, or a infiltration agent is applied to a surface of a preform made of the reinforcing agent.

As the infiltration agent, there may be used any substance that reacts with Mg or molten Mg with the evolution of heat. Especially preferred examples thereof include $SiO_2$ (silica) and $TiO_2$ (titanium oxide).

Although the amount of infiltration agent mixed or applied may vary according to the reinforcing agent, the infiltration agent is preferably used in an amount of 0.5(or 1) to 90% by volume based on the reinforcing agent. If the amount is less than the preferred range, the molten metal will fail to exhibit spontaneous infiltration, and if it is greater than the preferred range, the intermetallic compounds and oxides formed by the reaction of the infiltration agent with the molten metal may exert an adverse influence on the mechanical strength of the composite material.

Although the amount of reinforcing agent used in the preform may vary according to the type of the material used, it is preferably in the range of 5 to 70% (or 10 to 40% for silicon carbide, aluminum borate and the like). If the amount is less than the preferred range, it may be difficult to make a preform, and if it is greater than the preferred range, an improvement in the properties of the composite material may not be expected.

As the reinforcing agent, there may be used any of various reinforcing agents that are commonly used in metal-based composite materials. Specific examples thereof include SiC whiskers, aluminum borate whiskers, short alumina fibers [e.g., SAFFIL (trade name)], carbon fibers, potassium titanate whiskers, SiC fibers and carbon whiskers.

As used herein, the terms "whisker", "short fiber" and "fiber" can be defined as follows:

(1) Whisker

A whisker is monocrystalline and has an average diameter in the range of 0.1 to 1 μm, an average length in the range of 10 to 100 μm, and an average aspect ratio in the range of 5 to 1,000.

(2) Short fiber

A short fiber is polycrystalline and has an average diameter in the range of 1 to 10 μm, an average length in the range of 100 to 1,000 μm, and an average aspect ratio in the range of 5 to 1,000.

(3) Fiber

A fiber is monocrystalline or polycrystalline and has an average diameter in the range of 1 to 100 μm, an average length of 1,000 μm or greater, and an average aspect ratio in the range of 1,000 or greater.

When this process is carried out by using the above-described reinforcing agent and infiltration agent, any of the following embodiments may be employed.

(1) This process for producing a Mg-based composite material may be carried out according to an embodiment in which the reinforcing agent comprises SiC whiskers, the infiltration agent comprises $SiO_2$, $TiO_2$ or a mixture thereof, the total amount of the infiltration agent is from 0.5 to 90% by volume based on the SiC present in the SiC whisker preform, and the content of SiC whiskers in the preform is from 10 to 40% by volume.

(2) This process for producing a Mg-based composite material may be carried out according to an embodiment in which the reinforcing agent comprises carbon fibers, the infiltration agent comprises $SiO_2$, $TiO_2$ or a mixture thereof, the total amount of the infiltration agent is from 1 to 90% by volume based on the carbon present in the carbon fiber preform, and the content of carbon fibers in the preform is from 5 to 70% by volume.

(3) This process for producing a Mg-based composite material may be carried out according to an embodiment in which the reinforcing agent comprises aluminum borate whiskers, the infiltration agent comprises $SiO_2$, $TiO_2$ or a mixture thereof, the total amount of the infiltration agent is from 1 to 90% by volume based on the aluminum borate present in the preform, and the content of aluminum borate whiskers in the preform is from 10 to 40% by volume.

(4) This process for producing a Mg-based composite material may be carried out according to an embodiment in which the reinforcing agent comprises potassium titanate whiskers, the infiltration agent comprises $SiO_2$, $TiO_2$ or a mixture thereof, the total amount of the infiltration agent is from 1 to 90% by volume based on the potassium titanate present in the preform, and the content of potassium titanate whiskers in the preform is from 10 to 40% by volume.

(5) This process for producing a Mg-based composite material may be carried out according to an embodiment in which the reinforcing agent comprises short alumina fibers, the infiltration agent comprises $SiO_2$, $TiO_2$ or a mixture thereof, the total amount of the infiltration agent is from 1 to 90% by volume based on the alumina present in the preform, and the content of short alumina fibers in the preform is from 5 to 30% by volume.

In this process, a preform is made of the aforesaid reinforcing agent mixed with the aforesaid infiltration agent, or the aforesaid infiltration agent is applied to a surface of a preform made of the aforesaid reinforcing agent. Then, this preform is brought into contact with molten Mg or Mg alloy. As a result, the infiltration agent reacts with the molten Mg or Mg alloy with the evolution of heat, so that the molten Mg or Mg alloy spontaneously infiltrates into the preform. Thus, there can be obtained a Mg-based composite material which has been reinforced with at least one material selected from whiskers, short fibers and fibers.

In order to bring a preform into contact with molten Mg or Mg alloy and thereby induce a infiltration phenomenon, any of the following methods may be employed.

(1) The method of inducing a infiltration phenomenon by melting Mg or a Mg alloy on a preform having a infiltration agent incorporated therein or applied thereto.

(2) The method of inducing a infiltration phenomenon by pouring molten Mg or Mg alloy over a preform having a infiltration agent incorporated therein or applied thereto.

(3) The method of inducing a infiltration phenomenon by placing a preform having a infiltration agent incorporated therein or applied thereto on molten Mg or Mg alloy.

(4) The method of inducing a infiltration phenomenon by immersing a preform having a infiltration agent incorporated therein or applied thereto in molten Mg or Mg alloy.

Figure 9:
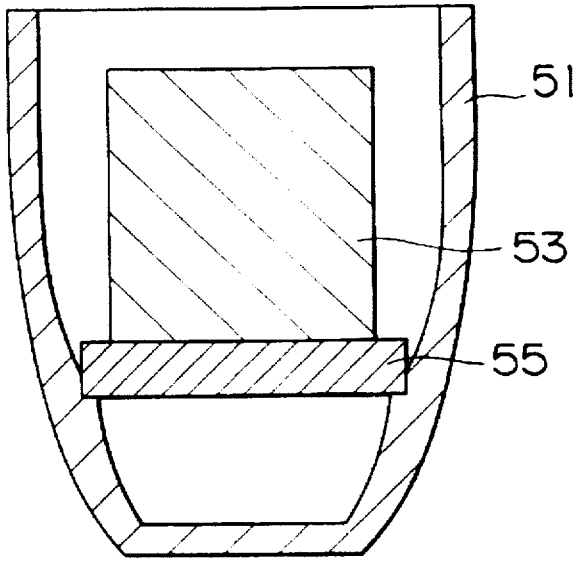
FIG. 9 is a sectional view of a graphite crucible for explaining a further process in accordance with the present invention which corresponds to the fifth object.
Figure 10:
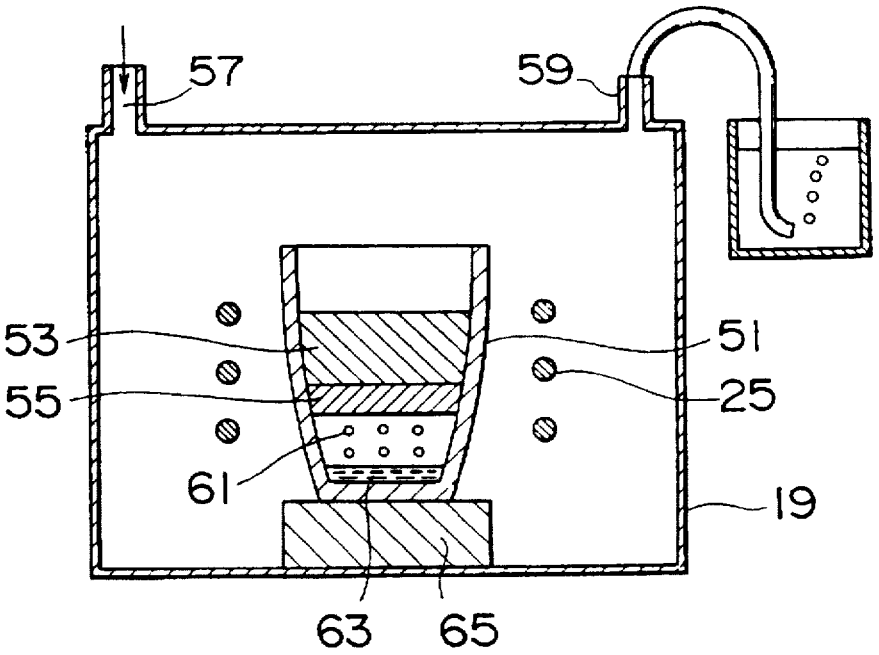
FIG. 10 is a sectional view illustrating an apparatus for carrying out the further process in accordance with the present invention which corresponds to the fifth object by using an induction heating coil.

FIGS. 9 and 10 illustrate an exemplary apparatus for carrying out the method of inducing a infiltration phenomenon by melting Mg or a Mg alloy on a preform having a infiltration agent incorporated therein or applied thereto.

This apparatus may be used in the following manner: First of all, a preform 55 is fixedly mounted in an intermediate part of a graphite crucible 51 as illustrated in FIG. 9. Then, an ingot 53 of Mg or a Mg alloy is placed on the preform.

FIG. 10 illustrates an arrangement suitable for making a Mg-based composite material by using the aforesaid graphite crucible 51. The graphite crucible 51 is placed on a crucible stand 65 surrounded by a high-frequency induction heating coil 25. The induction heating coil 25 is enclosed in a controlled-atmosphere chamber 19, and this chamber 19 is provided with an inlet 57 for introducing an atmosphere gas into the chamber 19 and an outlet 59 for discharging the displaced atmosphere to the outside.

As the atmosphere gas, there may used any of various gases commonly used as the atmosphere for melting Mg by the application of heat, such as Ar gas and a mixed gas composed of $CO_2$ and $SF_6$.

In operation, the Mg ingot 53 is melted by energizing the induction heating coil 25. The resulting molten metal infiltrates into the preform 55 and then drips in the form of droplets 61, so that a body of molten metal 63 is accumulated at the bottom of the crucible 51. Thus, a composite material is made as can be seen from Example 6 which will be given later.

Figure 12:
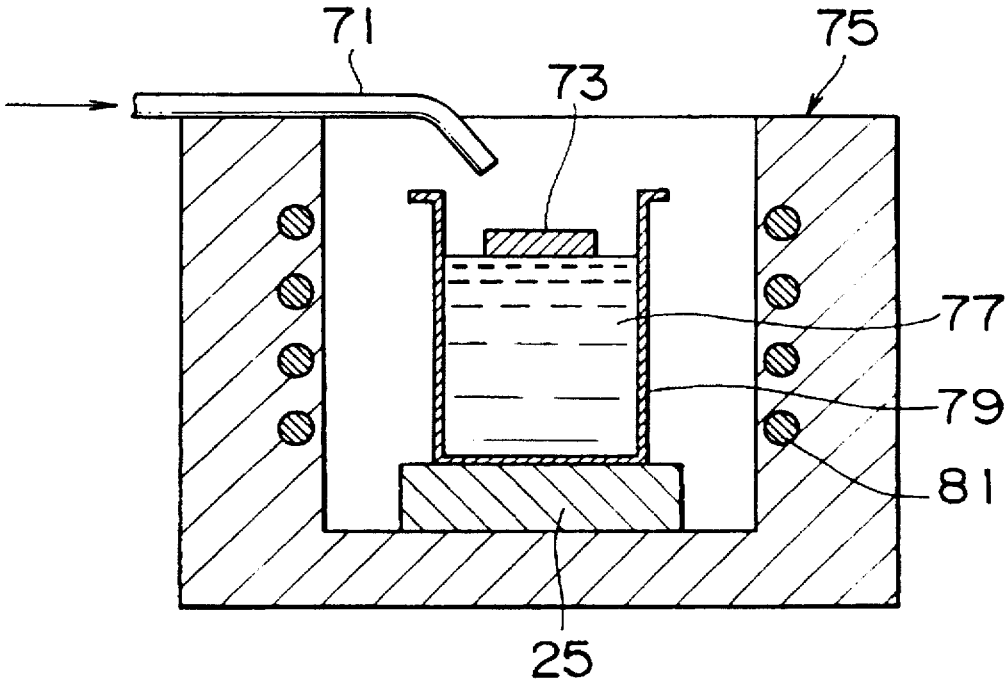
FIG. 12 is a sectional view illustrating an apparatus for carrying out the further process in accordance with the present invention which corresponds to the fifth object by using an electric resistance furnace.

FIG. 12 illustrates an exemplary apparatus for carrying out the method of inducing a infiltration phenomenon by placing a preform having a infiltration agent incorporated therein or applied thereto on molten Mg or Mg alloy.

In this apparatus, an electric resistance furnace 75 is used. In this furnace, Mg or a Mg alloy is charged into a crucible 79 made of steel and melted under an atmosphere of a mixed gas composed of $CO_2$ and 0.3% $SF_6$ to form a molten metal 77. Then, a preform 73 is placed on the molten metal 77 to induce a infiltration phenomenon. The mixed gas composed of $CO_2$ and 0.3% $SF_6$ is introduced through an inlet pipe 71, and the crucible 79 is placed on a crucible stand 25 and heated by an electric resistance heater 81.

Moreover, this process for producing a Mg-based composite material may also be carried out according to an embodiment in which a preform having a infiltration agent incorporated therein is made (or wound) around a core (e.g., of Mg, aluminum or titanium steel), or a infiltration agent is applied to a preform made (or wound) around a core; and this preform is used to form a composite material having a reinforced surface layer. This embodiment corresponds to Examples 8 and 10 which will be given later.

Furthermore, this process for producing a Mg-based composite material may also be carried out according to an embodiment in which a preform having a infiltration agent incorporated therein is made (or wound) around a core, or a infiltration agent is applied to a preform made (or wound) around a core; this preform is brought into contact with molten Mg or Mg alloy to induce a infiltration phenomenon; and the core is then leached out to form a hollow composite material. This embodiment corresponds to Example 9 which will be given later.

EXAMPLE 6

Using a kneading machine, SiC whiskers (manufactured by Tokai Carbon Co., Ltd.) were intimately mixed with $SiO_2$ particles (having a particle diameter of 1 μm) and sodium silicate powder. The $SiO_2$ particles were used in an amount of 15% by volume based on the SiC whiskers and the sodium silicate powder in an amount of 2% by weight based on the combined weight of the SiC whiskers and the $SiO_2$ particles. In this connection, the SiC whiskers contain 1.8% by volume of $SiO_2$ at the time of manufacture and the sodium silicate which is a compound oxide composed of $Na_2O$ and $SiO_2$ contains 65% by weight of $SiO_2$. Accordingly, the actual total amount of $SiO_2$ was 18.5% by volume based on SiC.

In this example, $SiO_2$ particles constitute a infiltration agent and sodium silicate functions primarily as an inorganic binder for solidifying the preform. The above-described mixture of SiC whiskers, $SiO_2$ particles and sodium silicate was pressed into a disc having a diameter of 50 mm and a thickness of 10 mm. Then, this disc was fired at 750° C. for 30 minutes to make a preform. The content of SiC whiskers in the preform was 20% by volume. This preform was fixedly mounted in an intermediate part of a graphite crucible 51 as illustrated in FIG. 9, and an ingot 53 of pure Mg was placed thereon. When the pure Mg was melted in an atmosphere of Ar (argon) by induction heating as illustrated in FIG. 10, the molten pure Mg spontaneously infiltrated into the preform 55. Moreover, the molten pure Mg passed through the preform 55 and filled the lower part of the graphite crucible 51.

Figure 11:
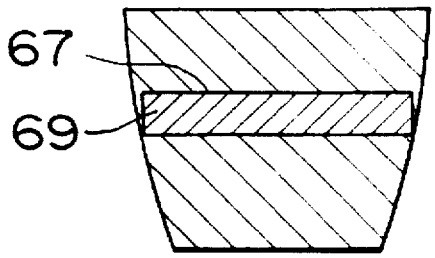
FIG. 11 is a sectional view for explaining a Mg-based composite material made in accordance with the present invention which corresponds to the fifth object.

After completion of the infiltration phenomenon, the heating was discontinued. After the molten metal was solidified, the resulting product was removed from the crucible 51. As illustrated in FIG. 11, this product was a casting having a composite part containing SiC whiskers 69. When this composite part 67 was observed under an optical microscope, it was confirmed that SiC whiskers were incorporated in the matrix comprising pure Mg. Moreover, MgO (magnesia) and $Mg_2Si$ (magnesium silicide), which were the reaction products of Mg with $SiO_2$ used as the infiltration agent, were also recognized in the matrix.

EXAMPLE 7

Using a kneading machine, SiC whiskers were intimately mixed with anatase-type $TiO_2$ particles (having a particle diameter of 0.4 μm) and sodium silicate. The $TiO_2$ particles were used in an amount of 20% by volume based on the SiC whiskers and the sodium silicate in an amount of 2% by weight based on the combined weight of the SiC whiskers and the $TiO_2$ particles. In this connection, the SiC whiskers contain 1.8% by volume of $SiO_2$ at the time of manufacture and the sodium silicate contains 65% by weight of $SiO_2$. Accordingly, the actual total amount of $SiO_2$ and $TiO_2$ was 23.5% by volume based on SiC. The aforesaid mixture was pressed into a disc having a diameter of 50 mm and a thickness of 10 mm. Then, this disc was fired at 750° C. for 30 minutes to make a preform. The content of SiC whiskers in the preform was 17% by volume.

On the other hand, as illustrated in FIG. 12, AZ91alloy (i.e., JIS MC2B alloy) was charged into a crucible 79 made of steel and melted at 700° C. in an electric resistance furnace 75 having an atmosphere composed of $CO_2$ and 0.3% $SF_6$. When the aforesaid preform was preheated to 700° C. and placed on the molten metal comprising AZ91alloy, an exothermic reaction took place between the molten metal 77 and the infiltration agent in the preform 73. At the same time, the molten metal 77 infiltrated into the preform 73 and, after a while, the preform 73 sank into the molten metal 77.

When the preform 73 saturated with the molten metal 77 was taken out of the molten metal 77 and cooled, there was obtained a Mg-based composite material which had a diameter of 50 mm and a thickness of 10 mm and was entirely reinforced with SiC whiskers.

EXAMPLE 8

Figure 13:
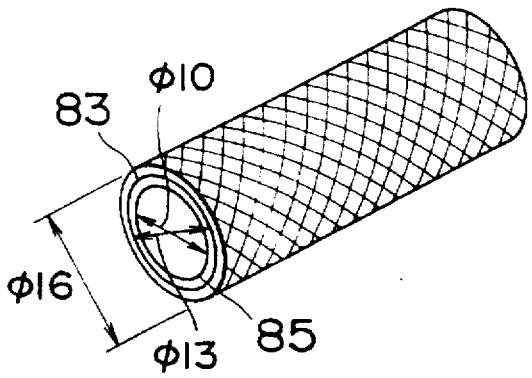
FIG. 13 is a perspective view for explaining an example of the further process in accordance with the present invention which corresponds to the fifth object.

As illustrated in FIG. 13, a tube 85 having an inner diameter of 10 mm, an outer diameter of 13 mm and a length of 50 mm was made of AZ91 alloy, and carbon fibers 83 were wound around it until an outer diameter of 16 mm was reached. This assembly was dipped in a slurry prepared by suspending 150 g of $SiO_2$ particles (having a particle diameter of 1 μm) in 1 liter of water, and then dried. On the basis of the weight gain, it was found that the carbon fibers 83 were present in an amount of 30% by volume and the content of $SiO_2$ was 20% by volume based on the carbon fibers 83. AZ91 alloy was melted at 700° C. in the same manner as described in Example 7 with reference to FIG. 12. Then, the aforesaid preform comprising an AZ91 alloy tube 85 having carbon fibers 83 wound around it was preheated to 550° C. and immersed in the molten metal comprising AZ91 alloy at 700° C. while the carbon fibers 83 remained wound around the AZ91 alloy tube 85.

Figure 14:
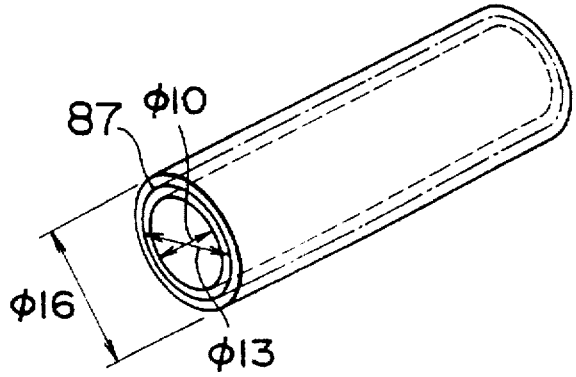
FIG. 14 is a perspective view illustrating a Mg-based composite material made in accordance with the present invention which corresponds to the fifth object.

A reaction took place between the molten metal and the infiltration agent, so that the molten metal infiltrated into the preform. The infiltration was completed in several seconds. Immediately after completion of the infiltration, the preform was taken out of the molten metal and cooled. Thus, there was obtained a reinforced Mg tube which, as illustrated in FIG. 14, had an inner diameter of 10 mm, an outer diameter of 16 mm and a length of 50 mm and included a 1.5 mm thick peripheral composite part 87 containing carbon fibers.

EXAMPLE 9

A tube having an inner diameter of 10 mm, an outer diameter of 13 mm and a length of 50 mm was made of pure Mg, and carbon fibers were wound around it until an outer diameter of 16 mm was reached. This assembly was dipped in a slurry prepared by suspending 150 g of $SiO_2$ particles (having a particle diameter of 1 μm) in 1 liter of water and further dissolving 30 g of sodium silicate therein, dried, and then fired at 600° C. for 5 hours.

Pure Mg was melted at 730° C. in the same manner as described in Example 7 with reference to FIG. 12. Then, the aforesaid preform comprising a pure Mg tube having carbon fibers wound around it was preheated to 630° C. and immersed in the molten metal comprising pure Mg at 730° C. while the carbon fibers remained wound around the pure Mg tube.

Figure 15:
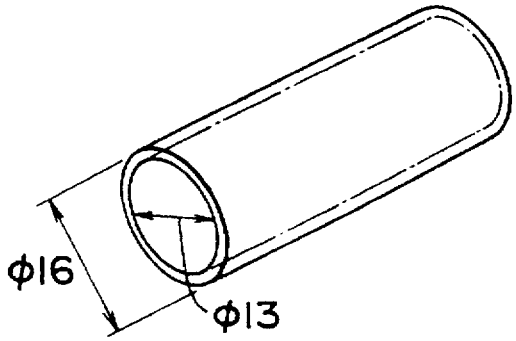
FIG. 15 is a perspective view illustrating another Mg-based composite material made in accordance with the present invention which corresponds to the fifth object.

A reaction took place between the molten metal and the infiltration agent, so that the molten metal infiltrated into the preform. The infiltration was completed in several seconds, but the preform was kept immersed in the molten metal for 20 minutes. Thereafter, the preform was taken out of the molten metal and cooled. The pure Mg tube had already been melted. Thus, there was obtained a Mg tube which, as illustrated in FIG. 15, had an inner diameter of 13 mm, an outer diameter of 16 mm and a length of 50 mm and was entirely reinforced with carbon fibers.

EXAMPLE 10

Figure 16:
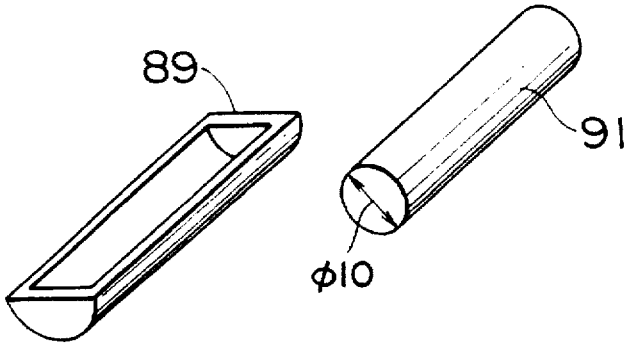
FIG. 16 is a perspective view for explaining another example of the further process in accordance with the present invention which corresponds to the fifth object.
Figure 17:
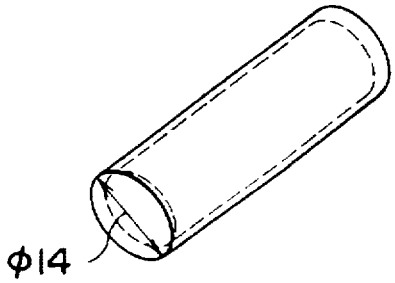
FIG. 17 is a perspective view illustrating still another Mg-based composite material made in accordance with the present invention which corresponds to the fifth object.

Using a kneading machine, SiC whiskers were intimately mixed with $SiO_2$ particles (having a particle diameter of 1 μm) and sodium silicate powder. The $SiO_2$ particles were used in an amount of 10% by volume based on the SiC whiskers and the sodium silicate powder in an amount of 2% by weight based on the combined weight of the SiC whiskers and the $SiO_2$ particles. In this connection, the SiC whiskers contain 1.8% by volume of $SiO_2$ at the time of manufacture and the sodium silicate contains 65% by weight of $SiO_2$. Accordingly, the actual total amount of $SiO_2$ was 13.5% by volume based on SiC. This mixture was pressed to form a mold 89 as illustrated in FIG. 16. A pure Mg cylinder 91 having a diameter of 10 mm and a length of 46 mm was fitted into the cavity of the mold 89. This assembly was set in another mold similar to the mold 89, covered with the aforesaid mixture, and then pressed. Thus, there was obtained a cylindrical preform having a diameter of 14 mm and a length of 50 mm and including a core comprising the pure Mg cylinder having a diameter of 10 mm and a length of 46 mm, as illustrated in FIG. 17. The obtained preform was fired at 600° C. for five hours.

AZ91 alloy was melted at 700° C. in the same manner as described in Example 7 with reference to FIG. 12. Then, the aforesaid preform was preheated to 630° C. and immersed in the molten metal comprising AZ91 alloy. A reaction took place between the molten metal and the infiltration agent, so that the molten metal infiltrated into the preform. Three minutes after completion of the infiltration, the preform was taken out of the molten metal and cooled. Thus, there was obtained a surface-reinforced Mg-based composite material in which the core comprised pure Mg and the surface layer comprised an AZ91 matrix reinforced with SiC whiskers.

EXAMPLE 11

Using a kneading machine, SiC whiskers were intimately mixed with 1% by weight based on SiC whiskers of sodium silicate powder. Fifteen grams of this mixture was pressed into a disc having a diameter of 50 mm and a thickness of 10 mm. Then, this disc was fired at 750° C. for 30 minutes to make a preform. The content of SiC whiskers in the preform was 24% by volume.

Using a brush, a slurry prepared by suspending 150 g of $SiO_2$ particles (having a particle diameter of 1 μm) in 1 liter of water was applied to one flat surface of the preform and then dried at 90° C. for 5 hours. The resulting coated preform weighed 15.2 g, indicating that 0.2 g of $SiO_2$ particles were applied to the preform. In this connection, the aforesaid SiC whiskers contain 1.8% by volume of $SiO_2$ at the time of manufacture and the sodium silicate contains 65% by weight of $SiO_2$. Accordingly, the actual total amount of $SiO_2$ was 4.6% by volume based on SiC.

Figure 18:
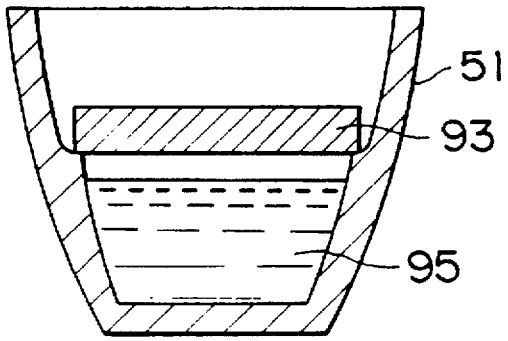
FIG. 18 is a sectional view of a graphite crucible for explaining still another example of the further process in accordance with the present invention which corresponds to the fifth object.
Figure 19:
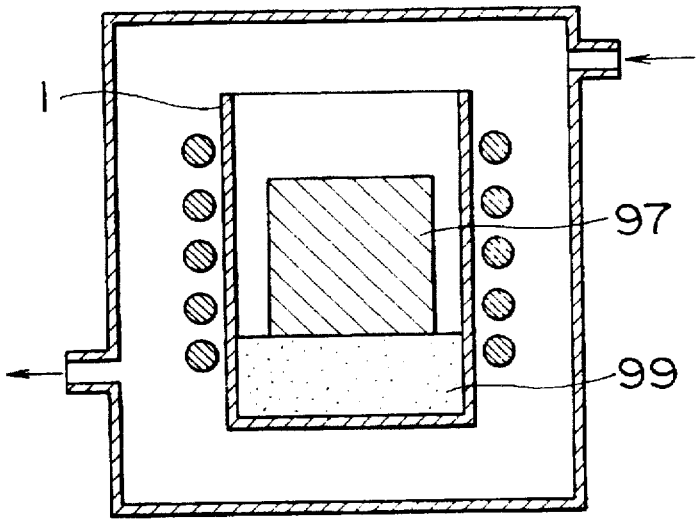
FIG. 19 (RELATED ART)
FIG. 19 is a schematic view for explaining a conventional process.
Figure 20:
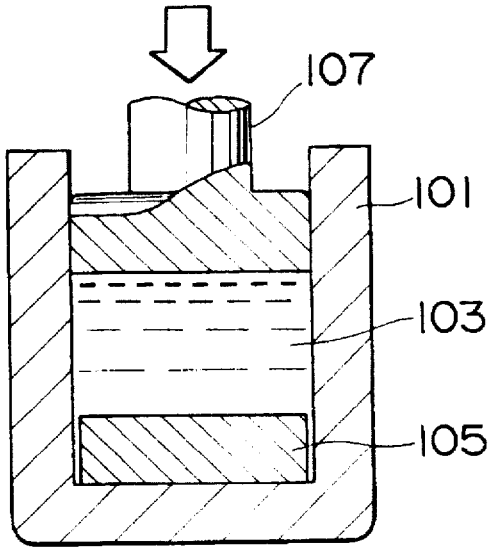
FIG. 20 (RELATED ART)
FIG. 20 is a schematic view for explaining another conventional process.

In the same manner as described in Example 6 with reference to FIG. 9, the $SiO_2$-coated preform was held in a graphite crucible 51 with its $SiO_2$-coated surface facing upward. When pure Mg 53 was placed on the preform 55 and melted in the same manner as illustrated in FIG. 10, the molten metal comprising pure Mg spontaneously infiltrated into the preform 55. Moreover, the molten pure Mg passed through the preform 55 and filled the lower part of the graphite crucible 51. After completion of the infiltration phenomenon, the heating was discontinued. After the molten metal was solidified, the resulting composite material 93 was removed from the crucible 51. Since the volume of the molten metal was smaller than that of the lower part of the crucible, the composite material 93 was obtained separately from pure Mg 95, as illustrated in FIG. 18.

We claim:

1. A process for producing a Mg-based composite material which comprises the step of bringing a powder mixture composed of a reinforcing agent and an infiltration agent into contact with a molten matrix metal comprising a material selected from the group consisting of Mg and a Mg alloy, and causing the molten matrix metal to infiltrate into the powder mixture spontaneously without pressurizing.

2. A process for producing a Mg-based composite material as claimed in claim 1 wherein the reinforcing agent comprises a substance which does not react with Mg and the infiltration agent comprises a substance which reacts with the molten matrix metal with the evolution of heat.

3. A process for producing a Mg-based composite material as claimed in claim 1 wherein the reinforcing agent is selected from the group consisting of SiC, $9Al_2O_3.2B_2O_3$, $Al_2O_3$, $K_2O.6TiO_2$, $Si_3N_4$, AlN and $B_4C$ and TiC.

4. A process for producing a Mg-based composite material as claimed in claim 1 wherein the reinforcing agent is SiC.

5. A process for producing a Mg-based composite material as claimed in claim 1 wherein the reinforcing agent comprises SiC, the infiltration agent comprises $SiO_2$, and the amount of $SiO_2$ present in the powder mixture is from 1 to 99% by volume.

6. A process for producing a Mg-based composite material as claimed in claim 1 wherein the infiltration agent comprises crystalline titanium oxide.

7. A process for producing a Mg-based composite material as claimed in claim 1 wherein the reinforcing agent comprises a substance having self-lubricating properties.

8. A process for producing a Mg-based composite material as claimed in claim 7 wherein the substance having self-lubricating properties is selected from the group consisting of graphite, hexagonal boron nitride and molybdenum disulfide.

9. A process for producing a Mg-based composite material which comprises the steps of making a preform which consists essentially of a reinforcing agent comprising a ceramic material which does not react with Mg and a Mg alloy, and an infiltration agent which reacts with molten Mg and Mg alloy with the evolution of heat; and causing a molten matrix metal comprising a material selected from the group consisting of Mg and a Mg alloy to infiltrate into the preform spontaneously without pressurizing.

10. A process for producing a Mg-based composite material as claimed in claim 9 wherein the step of making a preform comprises mixing the reinforcing agent with 0.5 to 90% by volume of the infiltration agent.

11. A process for producing a Mg-based composite material as claimed in claim 9 wherein the step of making a preform comprises shaping the reinforcing agent to form a shaped article and applying the infiltration agent to a surface of the shaped article.

12. A process for producing a Mg-based composite material as claimed in claim 9 wherein the reinforcing agent is selected from the group consisting of SiC, $Al_2O_3$, TiC, C, $9Al_2O_3.2B_2O_3$, $K_2O.6TiO_2$, $Si_3N_4$, AlN and $B_4C$, and the infiltration agent is selected from the group consisting of $SiO_2$, ZnO and $TiO_2$.

13. A process for producing a Mg-based composite material as claimed in claim 9 wherein the reinforcing agent comprises at least one material selected from the group consisting of whiskers, short fibers and fibers.

14. A process for producing a Mg-based composite material as claimed in claim 9 wherein the step of making a preform comprises making a preform around a core.

15. A process for producing a Mg-based composite material as claimed in claim 14 wherein a hollow composite material is formed by causing the molten matrix metal to infiltrate into the reinforcing agent and then leaching out the core.

16. A process for producing a Mg-based composite material as claimed in claim 9 wherein the reinforcing agent comprises SiC whiskers, the infiltration agent comprises at least one material selected from the group consisting of $SiO_2$ and $TiO_2$, the total amount of the infiltration agent is from 0.5 to 90% by volume based on the SiC present in the SiC whisker preform, and the content of SiC whiskers in the preform is from 10 to 40% by volume.

17. A process for producing a Mg-based composite material as claimed in claim 9 wherein the reinforcing agent comprises carbon fibers, the infiltration agent comprises at least one material selected from the group consisting of $SiO_2$ and $TiO_2$, the total amount of the infiltration agent is from 1 to 90% by volume based on the carbon present in the carbon fiber preform, and the content of carbon fibers in the preform is from 5 to 70% by volume.

18. A process for producing a Mg-based composite material as claimed in claim 9 wherein the reinforcing agent comprises aluminum borate whiskers, the infiltration agent comprises at least one material selected from the group consisting of $SiO_2$ and $TiO_2$, the total amount of the infiltration agent is from 1 to 90% by volume based on the aluminum borate present in the preform, and the content of aluminum borate whiskers in the preform is from 10 to 40% by volume.

19. A process for producing a Mg-based composite material as claimed in claim 9 wherein the infiltration agent is selected from the group consisting of $SiO_2$ and $TiO_2$.

* * * * *